United States Patent [19]

Schmidli

[11] 4,006,723

[45] Feb. 8, 1977

[54] CONTROL SYSTEM FOR STARTING AND STOPPING AN INTERNAL COMBUSTION ENGINE

[76] Inventor: Paul Schmidli, Birmensdorferstrasse 240, Zurich, Switzerland

[22] Filed: Oct. 24, 1974

[21] Appl. No.: 517,653

Related U.S. Application Data

[63] Continuation-in-part of Ser. No. 382,171, July 24, 1973, abandoned.

[30] Foreign Application Priority Data

| | | |
|---|---|---|
| July 25, 1972 | Switzerland | 11100/72 |
| Oct. 6, 1972 | Switzerland | 14699/72 |
| Jan. 19, 1973 | Switzerland | 737/73 |

[52] U.S. Cl. ..... 123/179 B; 123/179 BG; 123/179 K; 290/38 R; 290/37 R

[51] Int. Cl.[2] ..... F02N 17/00

[58] Field of Search ..... 123/179 BG, 179 B, 179 K; 290/37, 37 X, 38 R

[56] References Cited

UNITED STATES PATENTS

| | | | |
|---|---|---|---|
| 2,373,735 | 4/1945 | Alexander | 123/179 BG |
| 3,151,249 | 9/1964 | Ives | 123/179 BG |
| 3,192,395 | 6/1965 | Langldis | 290/38 R X |
| 3,275,836 | 9/1966 | Vamcha | 290/38 R |
| 3,603,802 | 9/1971 | Petric | 290/37 |
| 3,712,283 | 1/1973 | Kless et al. | 290/38 R X |
| 3,731,108 | 5/1973 | Kobara et al. | 290/37 X |
| 3,740,564 | 6/1973 | Wong | 290/37 X |
| 3,767,932 | 10/1973 | Bailey | 290/37 X |
| 3,779,349 | 12/1973 | Maruoka | 123/179 BG |

*Primary Examiner*—Ronald B. Cox

*Attorney, Agent, or Firm*—Finnegan, Henderson, Farabow & Garrett

[57] ABSTRACT

An internal combustion engine control system is disclosed wherein a switch is provided for stopping the engine when the ignition switch is closed and another switch is provided for re-starting the engine without operation of the ignition switch. The control system also includes a starter control which interrupts the engine starter circuit while the engine is running.

14 Claims, 6 Drawing Figures

CONTROL SYSTEM FOR STARTING AND STOPPING AN INTERNAL COMBUSTION ENGINE

This case is a continuation-in-part of U.S. application Ser. No. 382,171 now abandoned, filed July 24, 1973.

BACKGROUND

In the interests of environmental protection, it is advantageous if the engines of motor vehicles are stopped whenever the vehicle is standing still, — especially in lines, at barriers, at traffic lights, etc. — so that excessive charging of the atmosphere with exhaust gases can be avoided. Moreover, this would also prevent a useless burning up of fuel under what are often unfavorable conditions of combustion.

Since, however, the following starting process often lasts too long and is relatively troublesome for the driver, stopping the engine is in general refrained from.

The purpose of the present invention is the creation of a mechanism which makes it possible for the driver to turn off his engine even in the case of the shortest pauses, and to start it again simply, easily and surely, so that he can continue uninterrupted on his way.

This is achieved by the invention in that electric switching devices are provided, that are controlled by a starting switch, and which, upon activation of the starting switch, automatically turn the starter on and off, in order to set the engine in motion.

Thus it is possible to avoid the time-consuming and bothersome re-ignition of the engine through the use of the conventional ignition switch accomplishing re-ignition by a light touch on the starting switch to set the starter in motion and start the engine running. Because of this simplified possibility of control, it is easier for the driver to turn off the motor even when he stops for very short periods, i.e., every time he stops, and thereby to contribute to an essential decrease in the concentration of exhaust gas, especially in cities. Furthermore, the consumption of fuel, especially in inner-city travel, is limited to a minimum, which also spares the engine and eliminates unnecessary noise. The wear on the engine is also reduced, since it has been proved that idling causes a great deal of demand upon separate parts and leads to their abrasion. Finally, through the starting process, the vehicle can, practically speaking, be set immediately in motion, since with the automatic control the drive can remain turned on, or in the case of manual transmission, the clutch pedal need only, as when starting normally, be released slowly and the car thrown into gear.

According to a further development of the invention, a control switch is provided, which interrupts the starting circuit upon ignition of the engine, and keeps it disconnected while the engine is running. The control input of the starting circuit control switch is connected with an electronic control that is influenced by the engine speed.

Thus the mechanism can be set into operation in a simple and reliable manner in connection with a certain speed of engine rotation. This is allowed for by a precise adjustment of the starting mechanism, whereby the CO-content of the engine exhaust can be kept at a minimum during the starting operation. Thus, in the course of tests it was determined that in normal, well-adjusted automobiles without a starting mechanism, the CO-content rises temporarily during starting by 4–4.5%. After completion of the starting process, it sank to 1.8%. In contrast to this, when the starting device is used, the CO-content rises by only 2.5% during the starting process.

A further characteristic of the invention is the fact that the starting switch is connected with a control in such a way that, upon activation of the starting switch, the starting process is begun automatically, in connection with a signal of running of the engine, and that there is a stopping switch, upon activation of which the engine is shut off and the control is kept ready to start.

This measure simplifies maneuverability significantly, and increases operational reliability.

The invention consists in the novel parts, constructions, arrangements, combinations and improvements shown and described. The accompanying drawings which are incorporated in and constitute a part of this specification, illustrate several embodiments of the invention and, together with description, serve to explain the principles of the invention. Of the drawings.

DETAILED DESCRIPTION

Figure 1:
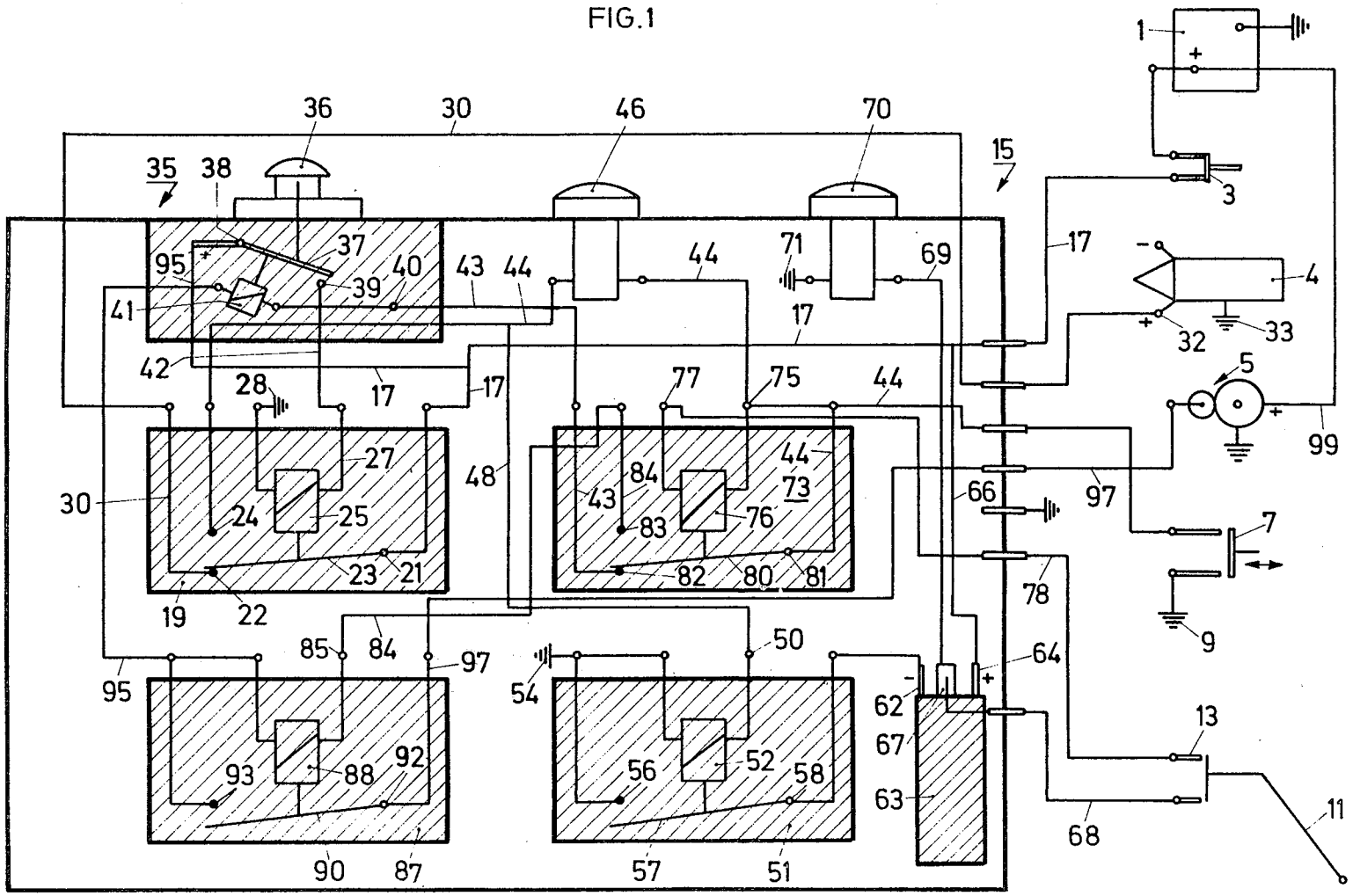
FIG. 1 is the wiring diagram of an engine control system formed in accordance with a first embodiment of this invention.

The engine control system of this invention lends itself especially for use in automobiles. According to FIG. 1, this car includes an auto battery 1, an ignition switch 3, an ignition coil 4, an automatic starter 5, as well as an oil pressure switch 7, one pole of which is positioned against the ground connection 9. The oil-pressure switch 7 opens when the oil pressure surpasses a certain limit, e.g., when it is greater than O atmospheric excess pressure. Furthermore, the gas pedal or accelerator 11 is integrated into the control system, and is connected with a switch 13.

To these well-known parts of an automobile are connected the parts described below, which are located essentially in one chamber 15. As is evident from the circuit diagram, in the chamber 15 there are arranged specifically five relays and a time delay switch, together with various pilot lamps.

FIG. 1 shows the switch position when the vehicle is moving normally and has to stop before a barrier or in a line for an undetermined amount of time. For the purpose of environmental protection, the engine should now be stopped temporarily and then automatically started up again.

As is seen in FIG. 1, a line leads from the ignition switch 3 to a center-zero relay 19, as well as to a pole 38 of a locking relay 35. The center-zero relay 19 has three poles 21, 22 and 24, as well as a lock-up bar 23, which is activated by means of an electromagnet 25. The magnet has an excitation line 27 and a second pole, connected with ground connection 28. The ignition coil 4 is connected with a pole 32 with positive supply voltage. It also has a ground connection 33.

In the position illustrated in FIG. 1, in order to stop the motor, the driver presses a retaining button 36 of the locking relay 35. This closes the lock-up bar 37, which is connected with the pole 38, and this in turn produces a connection to a second pole 39 and, therefore, through a line 42 to the electromagnet 25 of the center-zero relay. The locking relay 35 also has another pole 40, as well as a holding magnet 41, the function of which will be explained below.

Through the excitation of the electromagnet 25, the bar 23 is attracted toward the electromagnet 25 effecting connection between poles 21 and 24. Thereby the circuit through pole 22 and line 30 to the positive pole 32 of the ignition coil 4 is interrupted, whereupon the engine stops. At this moment, the oil pressure drops, and the oil-pressure switch 7 is closed. Because of the closed oil-pressure switch 7, a current can flow from the battery 1 through a line 17, the holding magnet 41, of which one pole is connected to line 17, on through a first pole 82 of the center-zero relay 73, its lock-up bar 80, to a second pole 81, then through a line 44 and the oil-pressure switch 7 to the ground connection 9, so that the holding magnet 41 operates and holds the lock-up bar 37 in its closed position connecting the poles 38 and 39.

By activating the retaining button 36 and closing the contacts 38 and 39, the line 17, the poles 21 and 24 and line 44 are supplied with current simultaneously, from the battery 1 through the ignition switch 3, inasmuch as at this time the oil pressure has dropped sufficiently that the oil pressure switch 7 closes. At this moment a pilot lamp 46, which is connected in line with line 44, lights up and indicates to the driver that he can release the retaining button 36. When the center-zero relay 19 is activated, a current flows through a line 48 to a pole 50 of a time switch relay 51. This pole 50 is the positive pole of an electromagnet 52, the other pole of which is connected to a ground connection 54. Another pole 56 of this relay 51 is also connected with ground connection 54. Upon excitation of the electromagnet 52, a lock-up bar 57 is deviated clockwise and the connection between pole 56 and another pole 58, as well as pole 62 of time delay switch 63 represented as a thermal-lag switch in the example, is produced. As a second pole 64 of the time delay switch 63 is connected by a line 66 to line 17 and so to the positive pole of the battery 1, the time delay switch will be switched on by connection of its control pole 62 to ground, so that pole 64 becomes connected with an output pole 67 of said switch.

The retaining button 36 can be released without the engine of the vehicle restarting.

The vehicle can be left in driving position, i.e., in the case of automatic transmission, in one of the forward positions, or in the case of a vehicle with a gear-shift, preferably in first gear.

Now when the line or the vehicle stopped before a barrier is to start moving again, the driver proceeds as follows.

The driver touches the gas pedal 11. By doing so he closes the switch 13. Now the current flows from the battery 1 through the closed ignition switch 3 and the line 17 as well as the line 66 to the pole 64 of the time delay switch 63. In this situation the time delay switch 63 is closed, as illustrated, so that the pole 64, with positive polarity, is connected to the output pole 67. This pole 67 is connected by a line 68, the closed switch 13 and a line 78 to a pole 77 of an electromagnet 76, which belongs to the center-zero relay 73, and which becomes supplied with voltage from the battery 1, whereby the other pole 75 of the electromagnet 76 is connected with ground connection 9 through line 44 and the oil-pressure switch 7. The electromagnet 76 that is energized in this manner attracts the lock-up bar 80, which now connects the two poles 81 and 83 to one another and disconnects the connection to pole 82, so that the circuit including the holding magnet 41 is opened and the holding magnet 41 is no longer energized. Thus, the lock-up bar 37 opens the connection to pole 39, which disconnects the exciter current to the electromagnet 25. The lock-up bar 23 returns to the position drawn. In so doing it reproduces the connection with the ignition coil 4 through pole 22 and line 30, and supplies the ignition coil with energy. The electromagnet 52 of the time switch relay 51 becomes disconnected from positive polarity by the action of relay 19. It opens therefore the connection from time delay switch pole 62 to ground and this thermo-switch will thereafter open connection between pole 64 and output pole 67 with a specific time delay from the moment of disconnection of pole 62.

Upon rotation of the lock-up bar 80, a closing relay 87 is activated by its magnet 88, one magnet pole of which is connected by a line 95 to the supply line 17, whereas the other 85 becomes connected by a line 84 to the now connected pole 83 of the center-zero relay 75, and so by lock-up bar 80, line 44, closed oil pressure switch 7 to ground 9. The lock-up bar of the relay 87 is attracted and connects a pole 93, connected to positive polarity line 95, with a pole 92, which is again connected by a line 97 to the starter 5. This causes the starter 5 to be supplied with current across a starter supply line 99, whereupon it reacts. Now the engine starts, the oil pressure rises, and the oil-pressure switch 7 opens. Thus, the exciter line to the exciter magnet 76 becomes de-energized, the relay drops and its bar 80 reconnects the two poles 81 and 82, as can be seen in FIG. 1. At the same time, line 84 also becomes currentless, as does the exciter line 84 to the electromagnet 88, so that bar 90 returns to its original position disconnecting the contacts 92 and 93 and opening the relay 87. Thus the control current to the starter 5 is interrupted and the starter is stopped from operating. In this position the entire mechanism is open and the switch positions correspond to that represented in the circuit diagram: The engine is running and the automobile is ready to drive.

A pilot lamp 70 is connected between ground 71 and, by a line 69, to the output pole 67 of the time delay switch 63, so that the lamp is lit up as long as said pole is connected to positive polarity. It is not possible to set the starter 5 under current by means of repeated activation of the gas pedal 11 while the motor is running, since the oil pressure switch 7 is then open. If within a certain time limit, according to the switching time delay of the switch 63, consisting, for instance, of 30 seconds, during which the contact through the thermocouple element (poles 64 and 67) remains closed, and lamp 70 is therefore on, another starting operation has to be carried out because, for example, the engine stopped after the first start, the driver can activate the starter 5 by means of repeated activation of the gas pedal 11 and closing of switch 13. Whether or not he can do this is indicated by the pilot lamp 70. When this control lamp goes out automatically after the determined time, because the time switch 63 reacts and releases the connection between the poles 64 and 67, the control system is in the shut off or resting position. When for some reason in this time span of perhaps 30 seconds the engine cannot be started, there exists the possibility of setting the control system into operation again by pressing the retaining button 36, or by setting the engine in motion normally with the ignition switch 3.

In place of the oil-pressure switch 7 another pilot switch can be provided, that indicates the running of the engine. Such a switch can, for example, react to the excess pressure in the exhaust system of a running engine. Furthermore, with the help of a suitable scanning switch, for example a HALL-element, the starting current can be determined, or the current balance of the battery can be scanned; in this latter case it is determined whether the battery is being charged, which is only the case when the engine is running, or whether it is being discharged, which is what happens because of the switched on auxiliary units while the engine is stationary. Furthermore, a tacho-alternator can be attached to the engine, and would give out a signal according to the engine speed. Finally, a centrifugal switch can be provided, which can be connected with the distributor, but which can also be arranged separately. Finally, it is possible to scan the engine vibrations arising upon starting of the engine and originating from its starting torque by means of a suitable pressure absorber, and thereby to obtain a control signal for switch 7.

In the following, an example of operation will be described, in which the ignition impulses are involved in the control of such a pilot switch.

Figure 2:
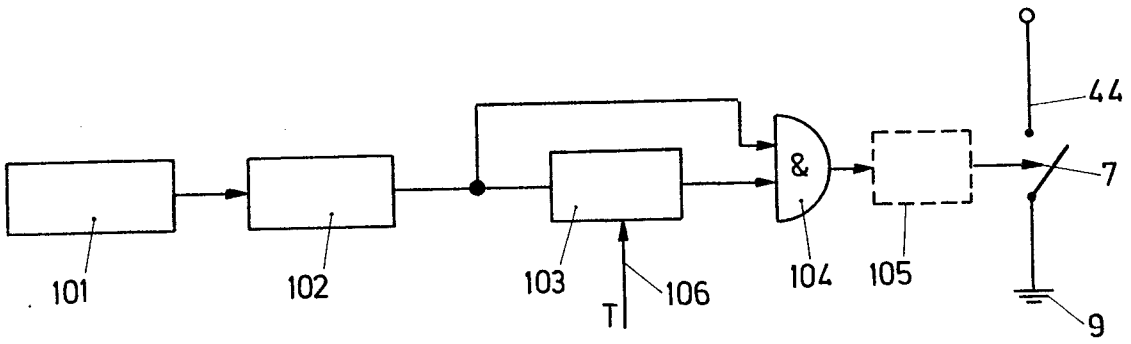
FIG. 2 is a schematic wiring diagram of a switch control which may be used with the system of FIG. 1.

According to FIG. 2 a scanner 101 is connected with a pulse shaper 102 at the entrance of a monostable multivibrator 103. The scanner 101 is connected to the ignition device of the motor vehicle, and scans the ignition impulse sequence. In addition, a scanning coil can be joined to the ignition cable or the distributor. Through each of the ignition impulses a current is induced in the scanning coil and is then conducted to the pulse shaper 102. Naturally, any other known device for the generation of scanning impulses can be used as a scanner, for example, a magnet or an opto-electric scanner.

The pulse shaper 102 transforms the scanned pulse spikes into square-wave impulses, which can be processed by the monostable multivibrator 103.

The monostable multivibrator 103 is triggered by the trailing edges of the scanning pulses of the pulse shaper, and produces then at its output one pulse of a time width T. This pulse with a pulse width according to T is led on one input of an AND-circuit 104 whereas the second input is connected directly to the output of the pulse shaper, by-passing the monoflop 103. So, if the pulses of the pulse shaper arrive at the AND-input when the monoflop-output is high, that is during time T, these pulses will be transmitted to the AND-output, otherwise, if they arrive after the time T, which is the case if the engine is running very slowly or is standing still, the AND-output will remain low and no pulses will be transmitted.

The output signal of the AND-circuit 104, which is stabilized by a low-pass filter 105 activates a movable switch 7. This switch 7, which replaces the oil-pressure switch 7 of FIG. 1, switches, upon appearance of a control signal, line 44, designated as in FIG. 1, to ground connection 9.

The function of movable switch 7, which is responsive to engine rotation sensing means 101, is absolutely identical to the function of the oil-pressure switch 7 of FIG. 1.

It is preferable that the monostable multivibrator 103 be equipped with a control input 106, through which the time constant T is adjustable. This input can, for example, be connected either with a potentiometer device 107 or any other setting device, with the help of which the time constant T of the multivibrator can be adjusted. Thus the mechanism can be adjusted to that lowest engine speed, at which the switch 7 closes.

Naturally it is possible to develop such a device for the analysis of ignition impulses not only on the basis of digital signal processing, but also on the basis of analogous signal evaluation.

It should also be mentioned that it is also possible to connect the scanner 101 to any part of the motor, for instance to the intake manifold. If the engine is started when the throttle is closed, a vacuum occurs in the induction port, which causes the reaction of a corresponding scanner.

Figure 3:
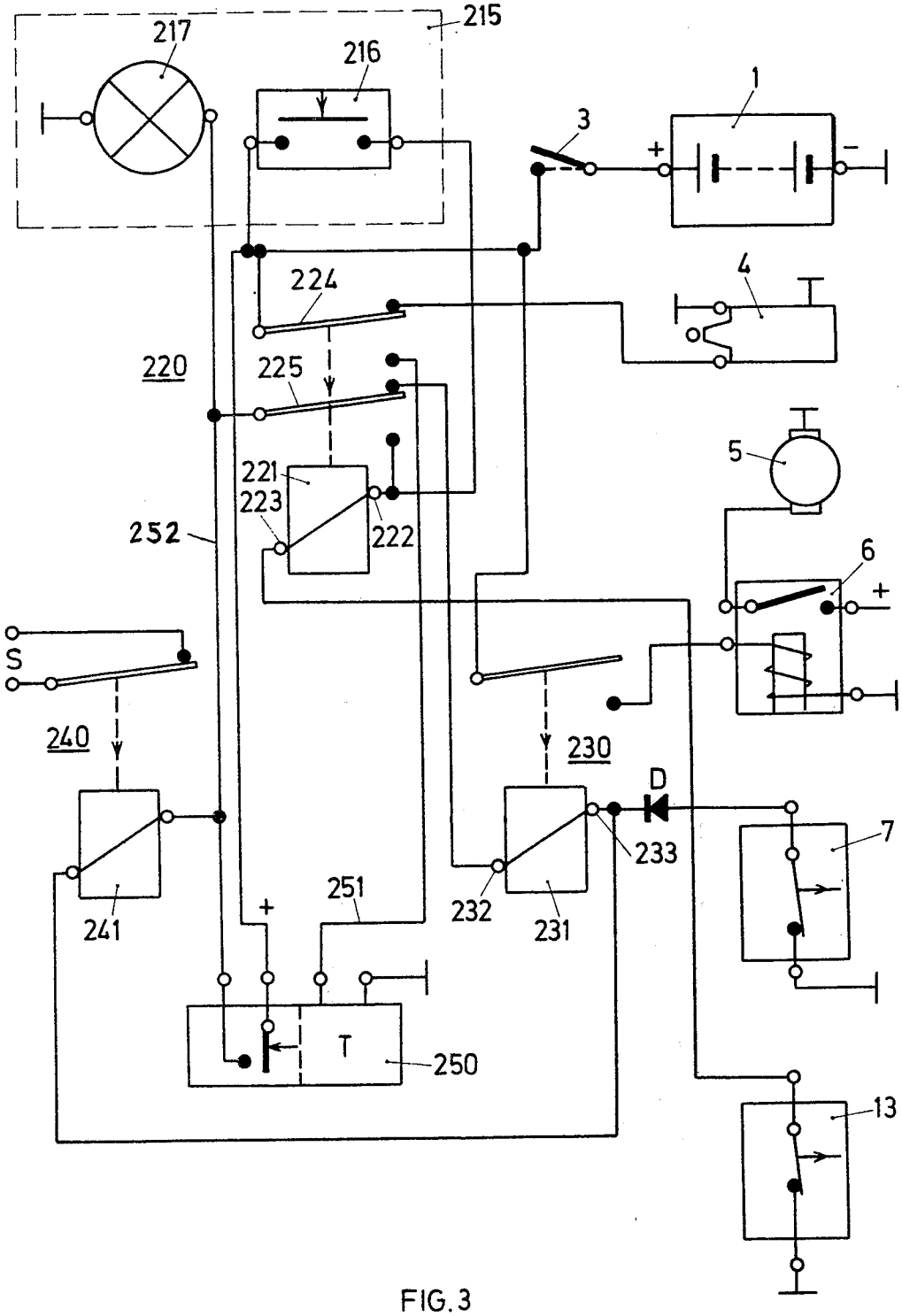
FIG. 3 is a schematic diagram of an engine control system formed in accordance with a second embodiment of this invention.

FIG. 3 shows another simplified example of operation of an engine control system. The leads of the control system are connected through the ignition switch 3 to the auto battery 1, then to the ignition coil 4 over the control winding of the starting relay 6 belonging to the starter 5, as well as to the pilot switch, e.g., the oil-pressure switch 7. Furthermore, a starting switch 13 that might be activated, for instance, by the gas pedal, is provided. The positions of the switch shown in the drawing correspond to the rest position of the mechanism.

The mechanism itself includes essentially a remote control device 215, a bipolar automatic relay or switch 220, a couple of unipolar switching relays 230 and 240, as well as a time switch 250.

The remote control device 215 includes a key switch 216, which connects the positive pole of the battery 1 with a pole 222 of the control winding 221 of the switch 220 when the ignition switch 3 is closed. Moreover, the remote control device 215 includes a pilot lamp 217, which is located between the output of the time switch 250 and the ground connection.

The automatic switch 220 is connected, by means of its second line 223 of the already mentioned control winding 221 to the starting switch 13, the second pole of which is grounded.

In the resting position the starting switch 13 is closed. The first connecting bridge 224 of the relay 220 connects the positive pole of the battery 1 with the ignition coil 4, when the ignition switch 3 is turned on, so that the vehicle is ready to operate in this position. The second connecting bridge 225 of the relay 220 connects the output of the time switch 250 with one line 232 of the control winding 231 belonging to the switching relay 230. If the connecting bridges 224 and 225 of the relay 220 are drawn by the control winding 221, the positive pole of the battery is connected with the control input of the time switch 250 and the output of the time switch 250 with the first line 222 of the control winding 221.

The second line 233 of the control winding 231 of the relay 230 is connected through a diode D to the pilot switch 7, which is an oil-pressure switch. The diode D prevents a possible reverse current from the oil-pressure pilot lamp (not shown), which is also connected to the oil-pressure switch 7. Between the second line 233 of the switching relay 230 and the output of the time switch 250 is the control winding 241 of the second switching relay 240. This switching relay serves as a headlight relay, which in the position shown keeps the large light S of the vehicle (dim light or high beam) on.

On the basis of a control signal on the pilot wire 251, the time switch 250 connects the positive pole of the battery to the outgoing circuit 252. The outgoing circuit 252 will only after a time delay T from the activation moment of switch 13 be disengaged from positive polarity.

In the following description of the operation of this invention, the ignition switch 3 is closed and the engine is running. If now, for example, the vehicle must stop before a traffic light and the engine must be stopped temporarily, the driver presses button 216. This excites the control winding 221 of the relay 220, whereupon the connecting bridge 224 moves to the lower position opening the ignition coil 4 circuit. Thereupon the engine stops, and the pilot wire 251 of the time switch 250 is connected with the positive pole of the battery through the connecting bridge 224. The time switch 250 connects the positive pole of the battery with its outgoing circuit 252 immediately thereafter. The second connecting bridge, which has in the meantime also been drawn toward the control winding 221, passes the current from this outgoing circuit 252 to the control winding 221, passes the current from this outgoing circuit 252 to the control winding 221, which is now kept under voltage until after touching of the starting switch 13, pole 223 becomes disconnected from ground and so relay 220 returns to its drawn position. Although the control entrance 251 of the time switch 250 then becomes disconnected from positive polarity too, the output 252 will remain connected to said polarity, for the time switch specific time delay T, so that relay 230 will only be activated during this time T, from the moment of opening switch 13.

During the time when the time switch 250 connects its outgoing circuit 252 to positive polarity, the pilot lamp 217, connected in parallel to the control winding 241 and switch 7, from the outgoing circuit 252 to ground, lights up visibly for the driver, indicating that the engine can be started by gas-pedal switch 13.

If the driver decides to start up again, he need only touch the starting switch 13, which opens. By this process, the voltage supply for the control winding 221 of the relay 220 is interrupted, whereupon the relay 220 returns to the position shown in FIG. 3. Thereupon, the control winding 231 of the switching relay 230 is excited by the outgoing circuit 252 of the time switch 250 through the second connecting bridge 225 of the relay 220, and on the other side through the pilot switch 7, which is closed while the engine stands still. This then connects the control winding of the starter relay 6 with the positive pole of the battery, whereupon the starting process begins. Since in the meantime the ignition coil has also been connected again with the positive pole of the battery through the first connecting bridge 224, all the switch conditions necessary for the starting of the engine have been fulfilled. When it starts, the pilot switch 7 opens, whereupon relay 230 drops and disconnects the starter circuit.

The control winding 241 of the headlight relay 240, which is also connected between the pilot switch 7 and the outgoing circuit 252, remains excited as long as the engine is temporarily standing still. At this time the large light of the vehicle is turned off, so that only its parking lights are burning, in accordance with the law in many countries. Besides this, an even charging of the battery is achieved, as it is alternately, but not simultaneously, loaded by the headlight and the starter. Naturally, in a simplified operation, relay 240 can be omitted.

If it should happen that the engine does not start within the pre-determined time span T of the time switch 250, which can amount to about 10 to 20 seconds, or if the engine should stop again, due to some wrong manipulation, it is possible to set the mechanism into operation again by a light touch on the key switch 216. It is also possible to let the function of the key switch 216 be taken over by the starter switch, which is usually combined with the ignition switch 3. Thus in a simplified operation the key switch 216 can be eliminated. Of course, both switches can also be located parallel to one another. In this way, even the first starting operation of the engine can be simplified essentially, as the starter switch need be activated only for a short time for the mechanism to respond. A touching of the starting switch 13 in order to open it is sufficient to start the engine. Thus the often improperly long activation of the starter switch by inexperienced drivers can be avoided.

As a starting switch 13 any other switch besides the mentioned gas pedal can be used, whose contacts are normally closed. For instance, this switch might be a starting button.

Also, other control signal sources besides the oil-pressure switch can be used as pilot switch 7 as described above.

It should also be mentioned, that in place of or in addition to pilot lamp 217 an acoustical signaller can be provided. In place of the described relays partly or exclusively electronic switches can be used. Also, single structural components such as the automatic switch 220 and the time switch 250 can be combined into a single group. A unit composed of the relay 220 and the time switch 250 would then operate as a monostable sweep circuit.

It should be pointed out that the time switch 250 can be of any kind. Besides electronic, thermal or any other known time switches can be used.

Figure 4:
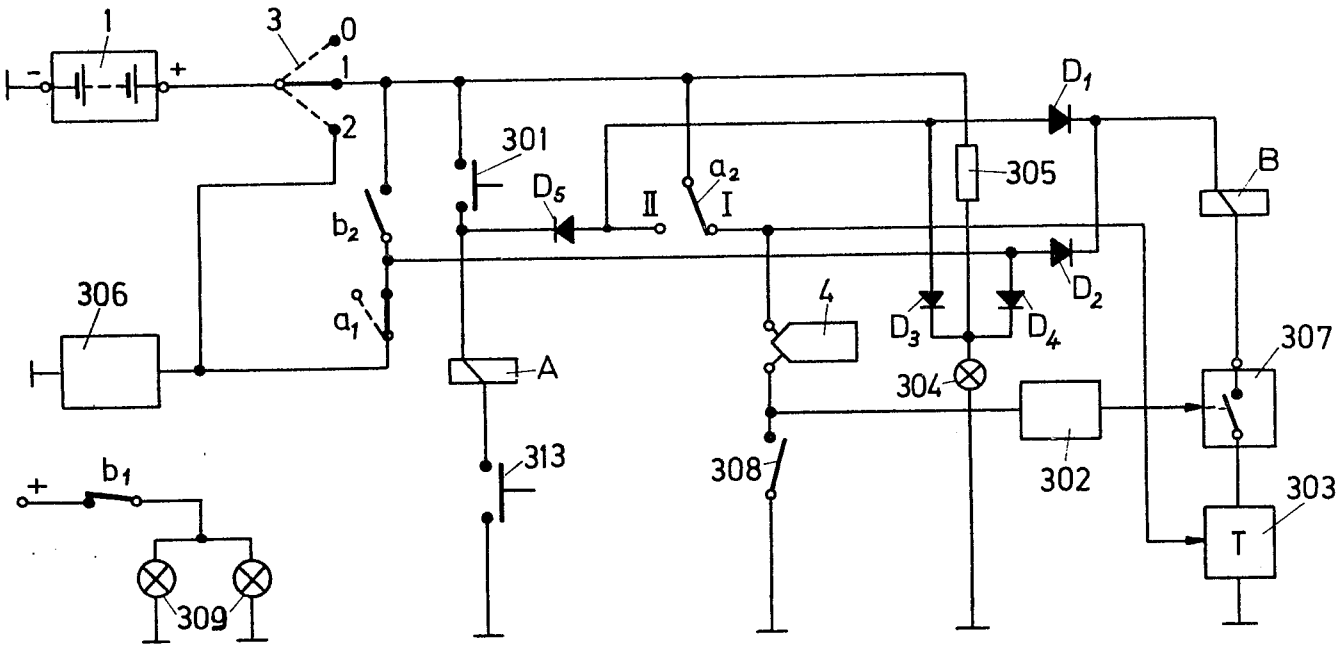
FIG. 4 is a schematic diagram of an engine control system formed in accordance with a third embodiment of this invention.

FIG. 4 shows a further example of operation of the engine control system of this invention, whereby the positions of the various switches while the motor is running are shown. The battery 1 is connected with the ignition switch 3, which is turned off and in position O. In position 1, the ignition is turned on, while in position 2 the starter, bypassing the represented starting mechanism, is directly connected with the battery 1.

To stop the engine, a stop switch 301 that is usually open is closed for a short time, whereby the induction coil of relay A is energized through the closed starting switch 313. Thereby a first operating contact $a_1$ of the first relay A, located in the circuit leading to the starter relay, is opened, while a second operating contact $a_2$ is switched from Position I to Position II as seen in FIG. 4. Thereby the ignition coil 4, which is located in line with the contact-breaker point 308 is disconnected from the power supply (battery 1). Furthermore, relay A becomes self-holding. At the same time, a second relay B is excited, whereupon its operating contact $b_1$ opens and thus turns off the dim light 309 of the vehicle.

Simultaneously a second operating contact $b_2$ in the circuit to the starter relay 306 is closed.

If the engine is to be started up again, the starting switch 313, which might be coupled with the gas pedal, is touched briefly, whereupon the first relay A is activated. The operating contact $a_1$ of this first relay thus closes, so that the starter relay is supplied with voltage through the already previously closed contact $b_2$ of the second relay B. Since the second operating contact $a_2$ of the first relay A has moved from Position II into Position I, the ignition coil 4 is also supplied with voltage. If the motor starts, a firing order scanner 302, at a certain, pre-determined firing order frequency, which is perhaps 100 revolutions per minute, gives off a control signal to the pilot switch 307, so that it opens. Thereupon the second relay B opens, whereupon its first operating point $b_2$ opens, and the starter relay 306 is cut off from the voltage. The starting process is thus completed. However, if the engine should not start up within a pre-determined time span of a time switch 303, even in this case the relay B is caused to drop by the opening of the ground connection. Various diodes $D_1$, $D_2$, $D_3$, $D_4$ and $D_5$ serve to balance out the single current paths.

A pilot lamp 304, which is connected to the contact point of Position I of the second operating contact $a_2$ or to the first operating point $a_1$ through the diodes $D_3$ and $D_4$, lights up when the engine is stopped and the mechanism is ready for use. Through a compensating resistance 305, which is directly connected with the ignition switch 3, the pilot lamp 304 can be caused to burn lightly during the operation of the vehicle.

Figure 5:
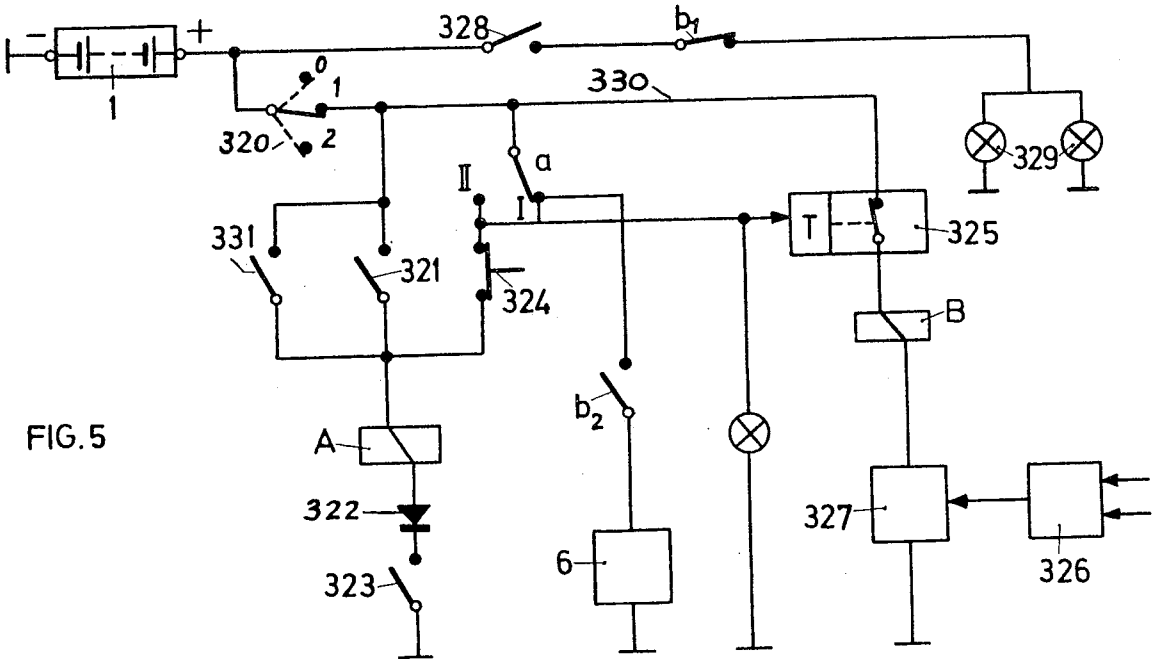
FIG. 5 is a schematic diagram of an engine control system formed in accordance with a fourth embodiment of the invention and which is for use with diesel engines.

In FIG. 5 another, easily modified example of operation of a starting mechanism for a diesel engine is described. This drawing also shows the switch positions while the engine is running. A master switch 320 connected to the battery 1, as well as a priming pump switch 321 are closed. The priming pump switch is generally coupled with the pedal for the brake. The switch remains open so long as the motor brake is not activated. But when the brake pedal is touched, switch 321 is closed. A stopping switch 331, which can be activated independently of the motor brake is connected parallel to the priming pump switch in the drawing. A relay A, located in line with the priming pump switch, and which is connected on the other side to ground through an oil-pressure switch 323 and an uncoupling diode 322, is inoperable in the position shown, since when the engine is running the oil-pressure switch is open. In place of the oil-pressure switch the charging indicator lights of the vehicle can be included; this is also disconnected, when the engine is running, by the regulator of the vehicle, which is not shown in the diagram.

If the vehicle is now brought to a standstill, for example by activation of the brake, both the priming pump switch 321 and the oil-pressure switch 323 are closed, whereby relay A is energized moving switch $a$ from Position I to Position II, so that the self-holding circuit for the induction coil of relay A closed through the closed starting switch 324. Furthermore, the positive terminal of the battery 1 is connected to a second relay B through a wire 330 and time switch 325; the second line of this relay being connected to ground through a likewise closed, controlled switch 327. The switch 327 is controlled by a signal scanner 326, which transforms a signal obtained from the lighting dynamo, the starter or any other suitable point in the engine, into a control signal for switch 327. When the relay B is activated, its operating contact $b_1$ is opened, whereby the dim lights 329 are turned off when the light switch 328 is closed. Besides this, a second operating contact $b_2$ of relay B is closed.

If now the engine is to be started up again, the starting switch 324 is lightly touched to open switch 324, whereupon the self-holding circuit for the first relay A is opened, since when the engine stands still, the priming pump switch 321 is opened upon release of the brake. Thus the switch $a$ of the relay A returns to Position I, and the starter relay 6 is supplied with voltage. From this moment on, the second relay B is supplied with voltage for a time span determined by the time switch 325, through line 330. If the signal scanner 326, which together with the controlled switch 327 corresponds to the pilot switch 7 of the previously described examples of operation, determines a potential difference between the decreasing starter tension when the motor is started and the increasing light machine tension, the controlled switch 327 is opened, whereupon the second relay B is de-energized. Thus the starting process is interrupted. If the engine should not start after the time determined by the time switch 325, the time switch interrupts the voltage supply through line 330, so that the relay B also opens.

Figure 6:
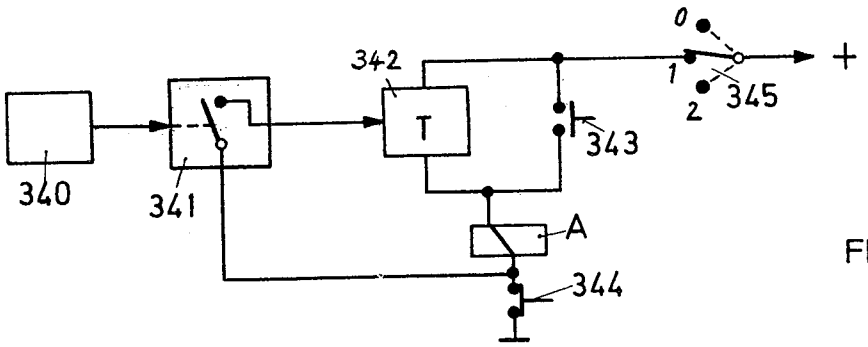
FIG. 6 is an additional device for the automatic switching on of the system of FIG. 5 while the vehicle is at a standstill.

In all the examples of operation hitherto described, the engine must be stopped by means of application of a separate stopping switch. According to the example of operation shown in FIG. 6, this can take place automatically. For this purpose a velocity dependent switch 341, which might be a drag switch, is connected to the speedometer 340 of the vehicle. In the example, the switch is so formed, that when the speedometer is running it is open, and when it stands still, it closes. This switch 341 is connected with a time switch 342, which lies parallel to a stopping switch 343 and on a line with the induction coil of a relay A, as well as with a starting switch, for example a gas pedal switch 344. If the vehicle is standing still, the starting switch 344 and the switch 341 are closed, and the time switch 342 begins to run for a pre-determined time of perhaps 10 seconds. After this time delay, the time switch causes a connection from the ignition switch 345, through the induction coil of the relay A and the closed starting switch 344, to the ground connection. Thereby relay A is energized, and the engine is stopped in one of the ways already described.

If for some reason the driver does not wish to stop the engine during this time, e.g., during the yellow phase of a traffic light, before it turns to green, the course of the time switch 342 can be interrupted by touching the starting switch 344, and it will begin again. Thus the pre-determined time interval can be lengthened if wished. However, the engine can be stopped in one of the ways already described at any time by means of the stopping switch 343.

It should also be mentioned that in all the examples of operation described, in which starting and stopping switches are provided, they can be replaced by a combination start-stop switch, which releases the engine in a first switch position, and introduces the starting process in a second position. Furthermore, the stop switch can be connected to the brake pedal for activation therewith.

The device described can of course be constructed partly or entirely of electronic components instead of the described relays. Since this however is a purely technical matter, we do not bother to describe the details.

What is claimed is:

1. A control system for stopping and starting an internal combustion engine provided with an ignition circuit and a starter motor, comprising:

a starter circuit coupled to said starter motor for controlling operation of the starter motor to start the internal combustion engine;

first operator actuated switch means for interrupting the ignition circuit to stop the internal combustion engine and for rendering said starter circuit capable of operation upon actuation thereof;

second switch means connected to said starter circuit and responsive to the operating state of the internal combustion engine, said second switch means being inoperative when the internal combustion engine is running to disable said starter circuit and operative when the engine is stopped to enable said starter circuit;

third operator actuated switch means connected to said starter circuit for closing said starter circuit and actuating said first switch means to close the ignition circuit upon actuation thereof to operate the starter motor and start the internal combustion engine, said second switch means being rendered inoperative when the internal combustion engine is started to terminate operation of the starter motor; and a time delay switch in said starter circuit rendered operative upon actuation of said first switch means to permit repetition of the starting operation during a predetermined time after actuation of said third switch means to close the ignition circuit.

2. The control system as defined in claim 1, wherein said second switch means comprises an oil-pressure controlled switch for interrupting said starter circuit when the engine is running.

3. The control system as defined in claim 1, wherein said first switch means is connected in circuit with an ignition coil in the ignition circuit.

4. The control system as defined in claim 1, wherein said second switch means is responsive to the speed of the engine.

5. The control system as defined in claim 1, wherein said first switch means is self-holding upon actuation thereof.

6. A control system for stopping and starting an internal combustion engine provided with an ignition circuit and a starter motor, comprising:

a starter circuit coupled to said starter motor for controlling operation of the starter motor to start the internal combustion engine;

first operator actuated switch means for interrupting the ignition circuit to stop the internal combustion engine and for rendering said starter circuit capable of operation upon actuation thereof;

second switch means connected to said starter circuit and responsive to the operating state of the internal combustion engine, said second switch means being inoperative when the internal combustion engine is running to disable said starter circuit and operative when the engine is stopped to enable said starter circuit; and third operator actuated switch means connected to said starter circuit for closing said starter circuit and actuating said first switch means to close the ignition circuit upon actuation thereof to operate the starter motor and start the internal combustion engine, said second switch means being rendered inoperative when the internal combustion engine is started to terminate operation of the starter motor;

said first switch means comprising a toggle switch having a first position in which the ignition circuit is closed and a second position in which the ignition circuit is open and a holding circuit rendered operable upon activation of said toggle switch to its second position to maintain said toggle switch in its second position, said holding circuit including a start switch having a first, normally closed position to complete said holding circuit, said start switch being operable to a second, open position to interrupt said holding circuit and allow said toggle switch to return to its first position to complete the ignition circuit, said third switch means being operable upon return of said toggle switch to its first position to actuate said starter circuit.

7. The control system as defined in claim 1, which includes a control coil connected between the output of said time delay switch and said second switch means for controlling the operation of an engine operated system.

8. The control system as defined in claim 6, which includes a time delay switch connected to said toggle switch and rendered operative upon actuation of said toggle switch to its second position, said time delay switch being operative for pre-determined time after return of said toggle switch to its first position to allow operation of said starter circuit.

9. The control system as defined in claim 8, wherein said third switch means comprises a relay switch having a normally open contact for controlling said starter circuit and a coil connected to said second switch means and rendered operative upon actuation of said time delay switch and return of said toggle switch to its first position to close said contact and actuate said starter circuit.

10. The control system as defined in claim 9, wherein said toggle switch comprises a double-pole reversing relay having a first contact connected to the ignition circuit with said toggle switch in its first position and connected to said time delay switch with said toggle switch in its second position and having a second contact connected between the output of said time delay switch and said coil of said start switch with said toggle switch in its first position and connected between the output of said time delay switch and said holding circuit for said toggle switch with said toggle switch in its second position.

11. The control system as defined in claim 8, which includes a control coil connected between the output of said time delay switch and said second switch means for controlling the operation of an engine operated system.

12. The control system as defined in claim 8, which includes indicator means connected to the output of said time delay switch.

13. The control system as defined in claim 6, wherein said start switch is operatively connected to an accelerator pedal of the engine.

14. The control system as defined in claim 1, wherein said first switch means is operatively connected to an engine brake.

* * * * *